United States Patent [19]

Schuller

[11] Patent Number: 4,768,663

[45] Date of Patent: Sep. 6, 1988

[54] COUPLING DEVICE FOR SCALE MODELS OF RAILWAY CARS

[76] Inventor: Wolfgang Schuller, 26, Am Parkfriedhof, 4300 Essen 1, Fed. Rep. of Germany

[21] Appl. No.: 15,060

[22] PCT Filed: Jun. 10, 1986

[86] PCT No.: PCT/EP86/00345

§ 371 Date: Feb. 9, 1987

§ 102(e) Date: Feb. 9, 1987

[87] PCT Pub. No.: WO86/07278

PCT Pub. Date: Dec. 18, 1986

[30] Foreign Application Priority Data

Jun. 11, 1985 {DE] Fed. Rep. of Germany ..... 3520856

[51] Int. Cl.[4] ..... A63H 19/18

[52] U.S. Cl. ..... 213/75 TC; 213/211; 105/1.5

[58] Field of Search ..... 213/75 TC, 211, 104, 213/100 R, 101, 172, 14; 105/1.5, 157.2; 104/DIG. 1

[56] References Cited

U.S. PATENT DOCUMENTS 2,102,649 12/1937 Rydin ..... 213/75 TC
2,149,840 3/1939 Christianson ..... 213/14
2,617,541 11/1952 Goode ..... 213/211
2,738,080 3/1956 Kastner et al. ..... 213/211
3,605,332 9/1971 Stepek ..... 213/75 TC
3,662,489 5/1972 Terrier ..... 213/75 TC

FOREIGN PATENT DOCUMENTS 3347084 7/1985 Fed. Rep. of Germany ... 213/75 TC

*Primary Examiner*—Robert B. Reeves
*Assistant Examiner*—Scott H. Werny

[57] ABSTRACT

A coupling device for scale model railway cars has a hook-shaped coupling element with a free end, a shaft connected to the coupling element, a crosspiece extending horizontally from both sides of the shaft. There is a chamber having a rear wall which defines an abutment surface facing the free end of the coupling element and a front wall opposite and spaced from the rear wall and defining at least in part a through opening for the shaft. There is at least one compression spring coupled with the shaft and/or the crosspiece and bearing against the front wall. The chamber houses the abutment surface, the crosspiece and spring, the latter seeking to hold the coupling element resiliently in the normal position but permitting a swiveling of the coupling element about a vertical axis against the force of the spring while the crosspiece is urged by the spring against the abutment surface.

14 Claims, 2 Drawing Sheets

COUPLING DEVICE FOR SCALE MODELS OF RAILWAY CARS

Figure 1:
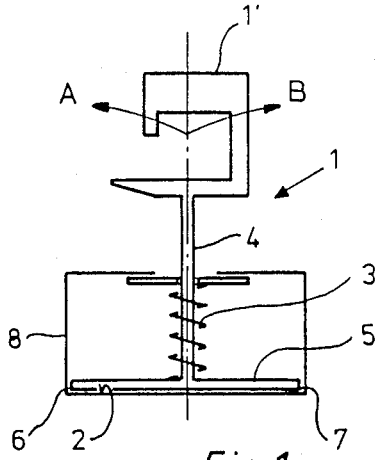

The invention relates to a coupling device on a model railway vehicle, which has a coupling element which is hook-shaped in plan, a shaft connected to the latter and having an axis which can be aligned in a normal position lengthwise of the vehicle, a crosspiece formed on the shaft and extending horizontally on both sides of the shaft, and spring means which, in cooperation with the rod and the crosspiece, seek to hold the coupling device resiliently in the normal position, but permit a pivoting of the coupling element about a vertical axis against the spring force, the crosspiece being urged by the spring means against an abutment surface facing the free end of the coupling element, so that, when the coupling element pivots, one of the end portions of the crosspiece forms on the abutment surface a pivot point situated on the pivot side.

In known coupling devices (DE Pat. No. 17 03 876) the crosspiece is biased by a compression spring against an abutment surface. In running curves the coupling device pivots laterally outward. The pivot point of the crosspiece is then on the side of the coupling device that is remote from the pivot side. The distance of the free coupling end from the car end, or buffer end as the case may be, is thereby shortened. In the case of two coupled vehicles, this shortening takes place at the ends of both vehicles. To prevent the buffer ends from coming in contact, the coupling must reach sufficiently far beyond the car end. The result is an excessively great distance between the buffers or cars and a recognizable departure from the real model.

In the publication, "Eisenbahn Magazin," of the Federal Republic of Germany, No. 10, 1976, pages 57–59, there is disclosed a short coupling similar to the kind described above, which permits minimizing the distance between buffers in straight running and increasing the coupling overhang with increasing deviation of the coupling from the center position. This known short coupling requires a complex and relatively large crosspiece design which, when negotiating curves, i.e., in the pivoted position, is strikingly and undesirably noticeable. A tension spring engaging the crosspiece biases the coupling device to the middle position.

It is the object of the invention to improve realism in the coupling of model railway vehicles while at the same time providing for reliable operation of the coupling device.

This object is achieved according to the invention by the fact that the abutment surface, the crosspiece and the spring are disposed in a chamber, that the chamber has a through-opening for the shaft permitting the swiveling movements of the shaft, and that the spring has at least one compression spring element coupled with the shaft and/or the crosspiece, which thrusts against an inner chamber wall opposite the abutment surface. This configuration enhances realism in the imitation of conditions in full-size railroads. When the distance of the free end of the coupling device from the end of the car increases, especially when the coupling swivels, only the length of the shaft projecting from the housing changes. This change of length is not noticeable. Also, operation more nearly approaching reality is achieved. Since the crosspieces are urged by spring forces against the abutment surfaces facing the free ends of the coupling, they can be lifted away against the spring bias by tensile forces. When a long train starts up, the vehicles coupled to one another are accelerated successively by the locomotive with action against the spring elements in the coupling devices. The starting force required is improved in comparison to the start-up performance of a train with known coupling devices, and the tendency of the wheels to spin on the tracks is reduced.

In another development of the invention, the shaft, the crosspiece and at least a part of the coupling device are made integrally of injection-molded plastic, while spring elements thrusting resiliently against at least one part of the chamber interior are integrally formed on the shaft and/or on the side of the crosspiece facing away from the abutment surface. In such a configuration the replacement of existing coupling devices with the coupling devices according to the invention is especially simplified.

In the known coupling devices it has often been observed that, in the case of coupling at low speed, the coupling devices were held so tightly by their springs in their coupling position that coupling failed to take place. In further development of the invention, therefore, the free end of the coupling device is disposed for pivoting about an axis disposed horizontally with respect to the crosspiece, especially for pivoting upwardly. Since in this configuration only the weight of the relatively light injection-molded part has to be lifted, coupling takes place reliably even when the vehicles come together slowly. Shifting the pivoting range out further out from the end of the vehicle also has the advantage that no space is required for the upward movement of the shaft and thus the end of the vehicle can be of a more realistic design. To prevent the free ends of the coupling device from being thrown upwardly in the event of a shock-like compressive force when the vehicles are pushed, the section of the coupling element which is facing the outermost free end of the coupling device with the coupling engaged and which has a substantially triangular profile with horizontally disposed edges, is configured complementary to the first coupling section and to its socket.

Especially in the case of narrow-gauge model railway vehicles, model parts are very frequently in the way of the swiveling movement of the coupling device and/or of a truck and/or of wheel deflections. In order nevertheless to assure sufficient freedom of movement of the coupling device, such model parts, in further development of the invention, are joined to the vehicle so as to be changeable in position. The coupling device and/or the swivel truck and/or the wheel suspension has, at a horizontally swingable or displaceable section, at least one actuator which can be brought into driving engagement with the displaceable-position model parts.

Model parts that are in the way of the swiveling movement are for instance the footboard systems on passenger cars. These have already been fastened on the swivel trucks of the cars, but this results in unsightly gaps between the car body and the footboard systems.

Preferably, the model parts, especially the footboard systems, are mounted for transverse displacement in a guide on the floor of the car. To prevent tilting in the guide and entanglement between the footboard systems of two coupled cars, the guides are disposed to run substantially concentrically about a vertical axis.

Preferably the footboard systems of opposite sides of a car are connected resiliently with one another and the footboard systems are disposed for displacement only outwardly from the circumferential profile of the vehicle. The spring system joining the footboard systems can be made integral with the footboard systems by injection molding.

In another further development of the invention, at least one actuator is provided on the swivel truck of a car, which engages the crosspiece or the shaft of the laterally swiveling coupling device, so that an uncoupled coupling will be held at about center-track on curves.

Since the coupling device according to the invention is of relatively short construction, the necessary lateral swing is accordingly slight and can be controlled by the swivel truck.

Known coupling devices have a coupling pin pointing toward the track, by which the cars can be uncoupled by means of a usually electromagnetically actuated device. For the uncoupling, the uncoupling pin runs onto a tripper lifted out of the ways, so that both of the coupling devices are lifted and thus taken out of engagement. This takes place while the train is being pulled. In many situations it is desirable to perform an uncoupling when a train is being pushed. For this purpose the coupling device that is to be disengaged must, in the state of the art, be positioned precisely over the tripper and then switched to run forward. This precise positioning is difficult in small model railways; moreover, the uncoupling position on the track is not always the place to which the car is to be shunted. To overcome these disadvantages, a separate tripper surface is provided for each of the uncoupling pins of the coupling devices for the preliminary uncoupling thereof, a first tripper surface when encountered exercising on a first coupling element an upwardly directed component of movement, a second tripper surface when encountered exercising a lateral component of movement on a second coupling element, and the trippers being so constructed and arranged that they become active successively in the uncoupling operation, the first tripper surface remains active until the second coupling member is deflected laterally all the way, and the second tripper surface is active until the first coupling member can swing back to its original position while the second coupling element is swung away. This construction of an uncoupling device makes it possible even with a pushed train to push the uncoupled car to a shunted-off position without another coupling action.

Figure 2:
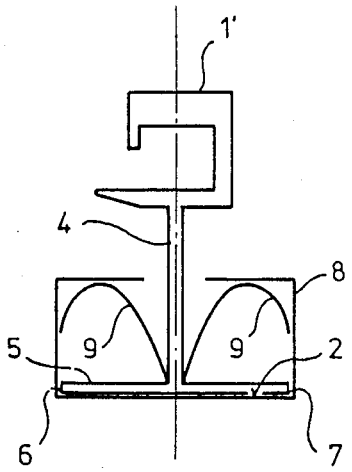
Figure 3:
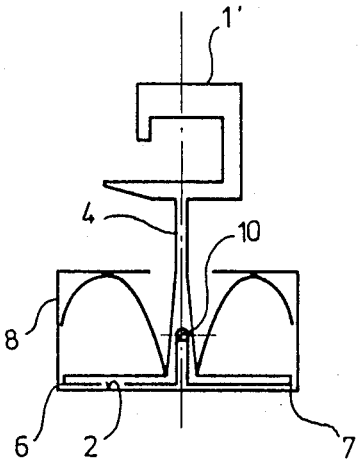
Figure 4:
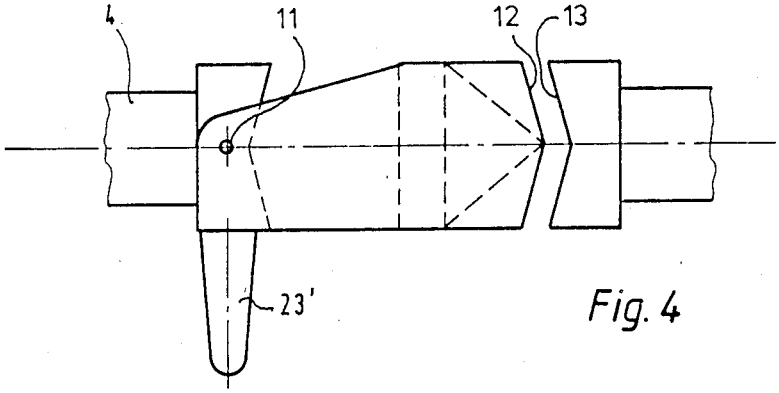
Figure 5:
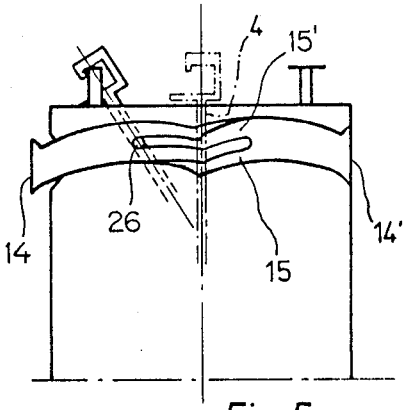
Figure 7:
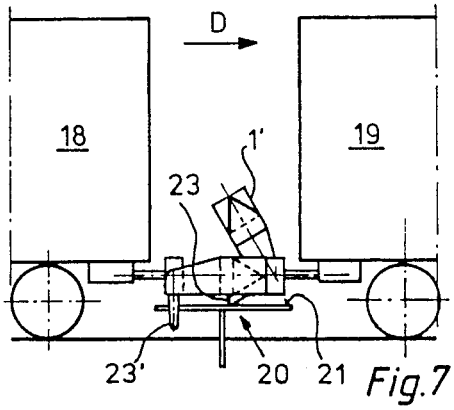
Figure 6:
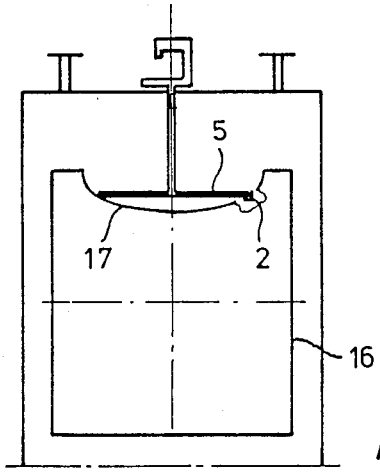
Figure 8:
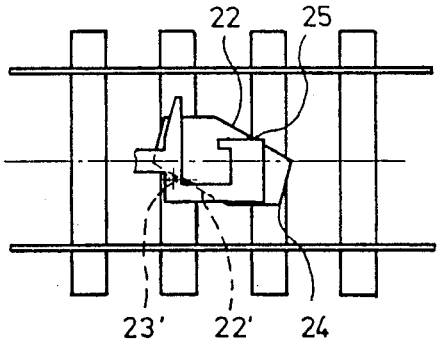

Embodiments of the invention are represented diagrammatically in the drawing, wherein:

FIG. 1 shows a second embodiment of a coupling device with a compression spring, FIG. 2 shows a third embodiment of a coupling device as an integral injection-molded plastic piece having integral spring elements, FIG. 3 shows a fourth embodiment with an additional pivoting of the shaft on a vertical axis, FIG. 4 shows the free end of the coupling device in its position in relation to the ground part of the coupling hook of a second coupling device, FIG. 5 shows footboard arrangements mounted for transverse displacement in the car body, FIG. 6 shows a swivel truck coupled to the coupling device for turning the coupling hook when negotiating curves, FIG. 7 shows an uncoupling device, and FIG. 8 is a top view of the uncoupling device.

The coupling device 1 is represented without the model parts of a model railroad car. It has a coupling hook 1', a shaft 4 and an crosspiece 5. By a compression spring 3 the crosspiece 5 is urged against an abutment surface 2 facing the free end (1') of the coupling device 1, the abutment surface being joined to the car body. When the coupling device 1 swivels in either of the two directions indicated by the arrows A and B, pivot points of the crosspiece 5 are produced at 6 and 7 on the abutment surface 2. The crosspiece 5, a portion of the shaft 4 and the compression spring 3 are disposed within a chamber 8. Instead of a compression spring 3, a resilient foam element, not shown, can urge the crosspiece 5 against the abutment surface 2.

Since coupling hook, shaft and crosspiece are preferably made in the form of a single plastic injection molding, additional spring elements 9, as represented in FIG. 2, can be included in the molding. These spring elements are supported against one or more walls of the chamber and urge the crosspiece 5 against the abutment surface 2.

In the embodiment according to FIG. 3, a vertical rod 10 is disposed in the chamber 8 and guides the shaft 4 in its swiveling movement. The pivot point 6 or 7 at the same time migrates inwardly on the abutment surface 2. The deflection of the coupling hook 1' in this embodiment is relatively slight.

In the embodiment according to FIG. 4 the front part of the coupling hook is pivotable about a horizontal axis 11. When the coupling hook swivels, therefore, the shaft 4 remains in the approximately horizontal normal position during a coupling or uncoupling action, and does not interfere with the coupling action. The outermost end 12 of the coupling hook 1' has an approximately triangular profile, and the bottom 13 of the coupling hook of a second coupler is of a configuration complementary thereto. In pushing operation, the complementary sections 12 and 13 lie one on the other, and any jumping upward or downward is prevented, and thus any uncoupling of the two couplers is forestalled.

In FIG. 5 there is represented the outline of one end of a model railway car with transversely shifting footboard systems 14 and 14'. On the left side the footboard system 14 is shifted outwardly, while the footboard system 14' on the right side is in the rest position. The two footboard systems are connected together by two plastic strips 15 and 15' which act as springs. The footboard systems can be made integral with the springs by injection molding. When the coupling hook is swiveled leftward, for example, an actuator 26 on the shaft 4 shifts the footboard system 14 outwardly from the rest position, so that it cannot interfere with the swiveling movement of the coupling. At the same time the plastic strips 15 and 15', as shown on the left side of the drawing, are drawn together. Their resilient properties move the footboard system 14 back to its starting position when the coupling hook swivels back. The actuator 26 does not come into active connection with the footboard system 14 or 14', on the turn side until the final phrase of the pivoting movement and again departs from this active connection before reaching the middle position.

In the embodiment according to FIG. 6, a swivel truck 16 guides the swiveling of an uncoupled coupler by means of a cam 17. By means of the cam 17, a swiveling movement of the coupling hook is achieved which is overproportional to the swiveling of the truck. The cam 17 engages the crosspiece 5 independently of the abutment surfaces 2. The chamber 8, which is not shown in FIG. 6, has for this purpose a slot-like, horizontally running opening through which the cam 17 can reach. With the aid of FIGS. 7 and 8 the uncoupling action of two coupled cars 18 and 19, which are running in the direction of the arrow D, is explained. An uncoupling device 20 has one horizontal tripper surface 21 and two lateral tripper surfaces 22 and 22'. In the state represented in FIG. 7, the coupling pin 23 of the coupling hook 1' of the car 19 has run against the upwardly acting tripper surface 21 and has been pivoted upward. As it can be seen in FIG. 8, the coupling pin 23' has just come in contact with the tripper surface 22'. As the cars continue to run in the direction of the arrow D, the coupling hook of car 18 is swiveled sideways relative to that of car 19. As movement continues in the direction of arrow D, the coupling hook belonging to car 18 is held in the laterally deflected position until the coupling pin can swing back inward again at point 24 of the uncoupling plate 20. At this moment the coupling hook of car 19 has dropped downward again, since its coupling pin has slipped off from the tripper surface 21 at about point 25. The inwardly swinging coupling hook of car 18 can no longer hook into coupling hook 1' of car 19 when the latter coupling hook is in the normal position, so that no recoupling takes place. The cars can thus be uncoupled and pushed to a remote off-shunted point.

I claim:

1. A coupling device on a model railway vehicle, said coupling device comprising:

a hook-shaped coupling element having a free end which is movable at least in a horizontal plane;

a shaft connected to said coupling element and having an axis which can be aligned in a normal position in a longitudinal direction of the vehicle;

a crosspiece formed on the shaft and extending horizontally from both sides of the shaft;

a chamber having a rear wall defining an abutment surface and facing the free end of the coupling element, and a front wall opposite and spaced apart from said rear wall, said front wall defining at least in part a through opening for said shaft; and spring means including at least one compression spring element coupled with at least one of said shaft and said crosspiece and bearing against said front wall opposite said rear wall;

said chamber housing the abutment surface, said crosspiece and said spring means, and said spring means seeking to hold the coupling element resiliently in the normal position but permitting a swiveling of the coupling element about a vertical axis against the spring force, while the crosspiece is urged by the spring means against said abutment surface.

2. A coupling device according to claim 1, wherein the shaft, the crosspiece and at least a portion of said hook-shaped coupling element are in the form of a one-piece plastic injection molding, and wherein said at least one compression spring element is integrally forced with at least one of said shaft and said crosspiece and inserted in said chamber such that said compression spring element resiliently bears against said front wall.

3. A coupling device according to claim 1, wherein said shaft has a slot running in the direction of the shaft axis for receiving a vertical rod disposed in the chamber.

4. A coupling device according to claim 1, wherein the free end of the coupling device is disposed for pivoting about a transversely disposed horizontal axis with disposed to the crosspiece.

5. A coupling device according to claim 1, wherein a coupling element section which is intended to confront the free end of the coupling device has a substantially triangular profile with horizontally running edges, and is configured complementary to the coupling element section and configured to accomodate the latter.

6. A coupling device on a model railway vehicle, said coupling device comprising:

a hook-shaped coupling element having a free end which is movable at least in a horizontal plane;

a shaft connected to said coupling element and having an axis which can be aligned in a normal position in a longitudinal direction of the vehicle;

a crosspiece formed on the shaft and extending horizontally from both sides of the shaft;

a chamber having a rear wall defining an abutment surface and facing the free end of the coupling element, and a front wall opposite and spaced apart from said rear wall, said front wall defining at least in part a through opening for said shaft; and spring means including at least one compression spring element coupled with at least one of said shaft and said crosspiece and bearing against said front wall opposite said rear wall;

said chamber housing the abutment surface, said crosspiece and said spring means, and said spring means seeking to hold the coupling element resiliently in the normal position but permitting a swiveling of the coupling element about a vertical axis against the spring force, while the crosspiece is urged by the spring means against said abutment surface;

said shaft having a slot running in the direction of the axis of the shaft; said slot being open toward the abutment surface; and end sections of the shaft widening to form sections of the crosspiece.

7. A model railway vehicle comprising a vehicle floor, at least one first movable vehicle component pivotably mounted to said floor in an end portion of the vehicle and comprising an actuator which moves along a path, spring means seeking to center said first movable component in a lateral direction of the vehicle but permitting a swivelling of said first movable component about a vertical axis against the force of said spring means, at least one second movable vehicle component mounted to interfere with said path of said actuator such that said actuator engages said second movable vehicle component only in a final phase of the pivoting movement of the first movable vehicle component and causes said second movable component to be carried along with said first component, said actuator disengaging said second movable component from said first movable component before the first movable component is centered.

8. A model railway vehicle according to claim 7, wherein said second components are footboard systems of the vehicle and are held for transverse displacement on the vehicle floor in at least one guide which runs in a curve about a vertical axis.

9. A vehicle according to claim 8, wherein the footboard systems are connected resiliently with one another and are displaceable outwardly beyond the circumferential profile of the vehicle.

10. A vehicle according to claim 9, wherein said footboard systems are formed in one piece as an injection molding of plastic.

11. A vehicle according to claim 7, wherein said first movable vehicle component is a vehicle coupling device.

12. A vehicle according to claim 7, wherein said second movable vehicle component is a swivel truck.

13. An uncoupling device for coupling devices on model railway vehicles equipped with uncoupling pins projecting toward a track of the model railway, comprising: a tripping body to be arranged between the rails and having a separate tripping surface for each of the uncoupling pins, a first tripping surface for exerting an upwardly directed component of movement on a first coupling hook when encountered, a second tripping surface for exerting a lateral component of movement on a second coupling hook when encountered, the tripping surfaces being so configured and disposed that they act successively during uncoupling, the first tripping surface remaining active until the second coupling hook has been pivoted fully to one side, and the second tripping surface being active until the first coupling hook swings back vertically to a starting position, with the second coupling hook disengaged therefrom.

14. A device according to claim 13, wherein the tripping body has a horizontal plate disposed above track level and on diagonally opposite sides, as said second tripping surfaces, edges which run at an angle to the track direction.

* * * * *